US006634786B2

(12) United States Patent
Dinger et al.

(10) Patent No.: US 6,634,786 B2
(45) Date of Patent: Oct. 21, 2003

(54) WRISTWATCH PROVIDED WITH AN ANTENNA

(75) Inventors: Rudolf Dinger, Saint-Aubin (CH); Dominique Dubugnon, Etoy (CH); Jean-Claude Martin, Neuchâtel (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/739,643

(22) Filed: Dec. 20, 2000

(65) Prior Publication Data

US 2001/0006490 A1 Jul. 5, 2001

(30) Foreign Application Priority Data

Dec. 29, 1999 (CH) ..... 99-2393

(51) Int. Cl.[7] ..... G04B 47/00; G04B 37/00

(52) U.S. Cl. ..... 368/283; 368/10; 368/13; 368/276; 455/575; D14/138; D10/31

(58) Field of Search ..... 368/4, 13, 10, 368/276, 278, 282; D14/138; D10/31; 455/347, 351, 89, 90, 575; 379/433.1

(56) References Cited

U.S. PATENT DOCUMENTS

D210,462 S * 4/1968 Roberts et al. ..... D10/31
5,189,431 A 2/1993 Marinelli
5,239,521 A * 8/1993 Blonder et al. ..... 368/10
5,381,387 A * 1/1995 Blonder et al. ..... 368/10
5,467,324 A * 11/1995 Houlihan ..... 368/10
5,499,292 A * 3/1996 Blonder et al. ..... 368/10
5,564,082 A * 10/1996 Blonder et al. ..... 368/10
6,212,414 B1 * 4/2001 Alameh et al. ..... 455/575
D456,791 S * 5/2002 Forakis et al. ..... D10/31

OTHER PUBLICATIONS

Patent Abstract of Japan, vol. 018, No. 531 (E–1614), Oct. 7, 1994 & JP 06 188809 Jul. 8, 1994.

Patent Abstract of Japan, vol. 1999, No. 5 May 31, 1999 & JP 11 055143 Feb. 26, 1999.

* cited by examiner

*Primary Examiner*—David Martin
*Assistant Examiner*—Jeanne-Marguerite Goodwin
(74) *Attorney, Agent, or Firm*—Sughrue Mion, PLLC

(57) ABSTRACT

The wristwatch (1) provided with a telephone device (3) able to receive and transmit messages broadcast by an antenna (4). The antenna (4) is integrated in a tongue (5) one (7) of the ends of which is attached to the wristband. The tongue can be arranged in a first position in which it runs alongside the wristband at least partly and is merged with it or a second position in which it is moved away from the wristband and stands upright in a plane containing the circle defined by the wristband when it is worn.

8 Claims, 3 Drawing Sheets

WRISTWATCH PROVIDED WITH AN ANTENNA

BACKGROUND OF THE INVENTION

The present invention relates to a wristwatch containing a telephone device able to receive and transmit broadcast messages received and transmitted by an antenna.

It has been proposed many times to combine a wristwatch with a telephone apparatus adapted to be able to receive and transmit high frequency electromagnetic signals. The continued expansion of radio frequency telecommunication systems, in particular mobile telephone systems, has led to a growing demand for increasingly compact and light portable equipment. In parallel to the technological advances which have allowed the development of electronic circuits and radio frequency circuits of small size and the development of high performance power sources, antennas of small profile suitable for mounting in portable communication units have already been proposed.

For example, European Patent No. 0 186 804 discloses a wristwatch including a case and a wristband associated with the case. The case includes an electric circuit provided with an integrated circuit and a display device, the case being closed by a crystal. The wristband includes two strips formed of a flexible plastic material and a conductor forming an antenna, arranged between these two strips. One of the strips includes a thick zone, of convex shape in which a transverse hole is made to receive a bar which is used to hinge the wristband onto the case.

In a similar manner, U.S. Pat. No. 4,754,285 discloses an antenna which winds through the wristband of an instrument worn on the wrist.

The wristwatch disclosed in European Patent No. 0 339 482 proposes an antenna which is not incorporated in the wristband, but wound around the watch case.

In all the aforecited examples, the antenna is arranged in immediate proximity to the wrist of the person carrying the instrument and adheres to his skin in some way. As a result, the radio frequency signal available is partly absorbed by the mass represented by the wrist, which decreases the amplitude of the useful signal reaching the telephone device. It will thus be understood that the apparatus can only operate properly if it is located in a strong signal zone, which limits the geographical range in which this apparatus can operate with security and reliability.

SUMMARY OF THE INVENTION

In order to overcome the above described drawback and consequently to increase the amplitude of the signal received or transmitted by the radio frequency device, the wristwatch of the present invention is characterised in that its antenna is integrated in a tongue one of the ends of which is attached to the wristband or to the watch case, this tongue being able to be arranged in at least two positions, a first position in which it runs alongside the wristband at least partly and is merged with it and a second position in which it is moved away from the wristband and stands upright in the plane containing the circle defined by the wristband when it is worn.

BRIEF DESCRIPTION OF THE DRAWING

In a preferred embodiment of the invention, the end of the tongue is attached to the case by means of an articulation located above the point of origin of the wristband on the watch case.

The features and advantages of the present invention will now appear from the following description, made with reference to the annexed drawing and giving, by way of non limiting explanation, an advantageous embodiment of the invention, in such drawing:

FIG. 1 is a perspective drawing illustrating wristwatch 1 of the invention. It is formed of a case 2 and a wristband 6. In a preferred version of the invention case 2 and wristband 6 are made in one piece of a semi-rigid plastic material. In addition to the components necessary for the time-keeping function, the case contains a telephone device 3 able to receive and transmit radio broadcast messages. Telephone device 3, which is not visible in FIG. 1, is sketched in FIG. 4. The case also contains other elements which are indispensable for the telephone function, but not shown here. One can find in European Patent No. 0 899 635 how to integrate a speaker and a microphone in the watch case. Numerous other documents describe the integration of a keyboard into said case. The radio broadcast messages are received and transmitted by an antenna 4 which will now be described in detail since it constitutes the main object of the present invention.

Figure 1:
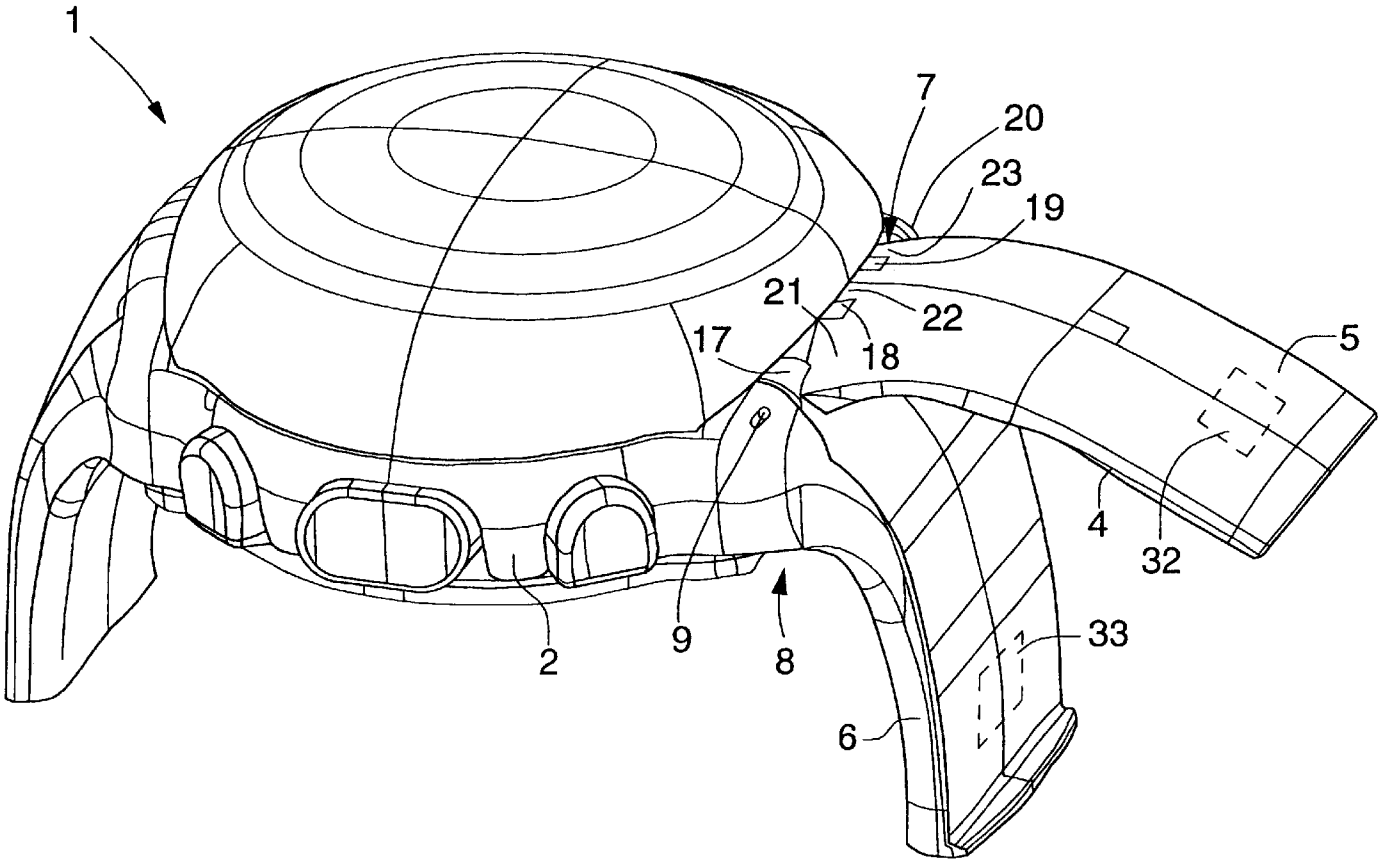
FIG. 1 is a perspective view of the wristwatch of the invention, this watch being fitted with a tongue in which an antenna is integrated.
Figure 3:
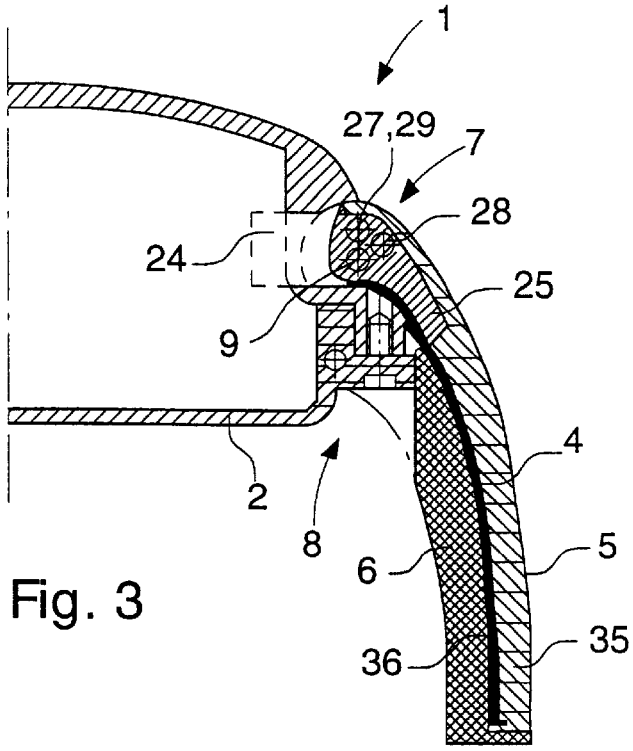
FIG. 3 is a cross-section of the watch illustrated in FIG. 1, the tongue being shown merged with the wristband.
Figure 2:
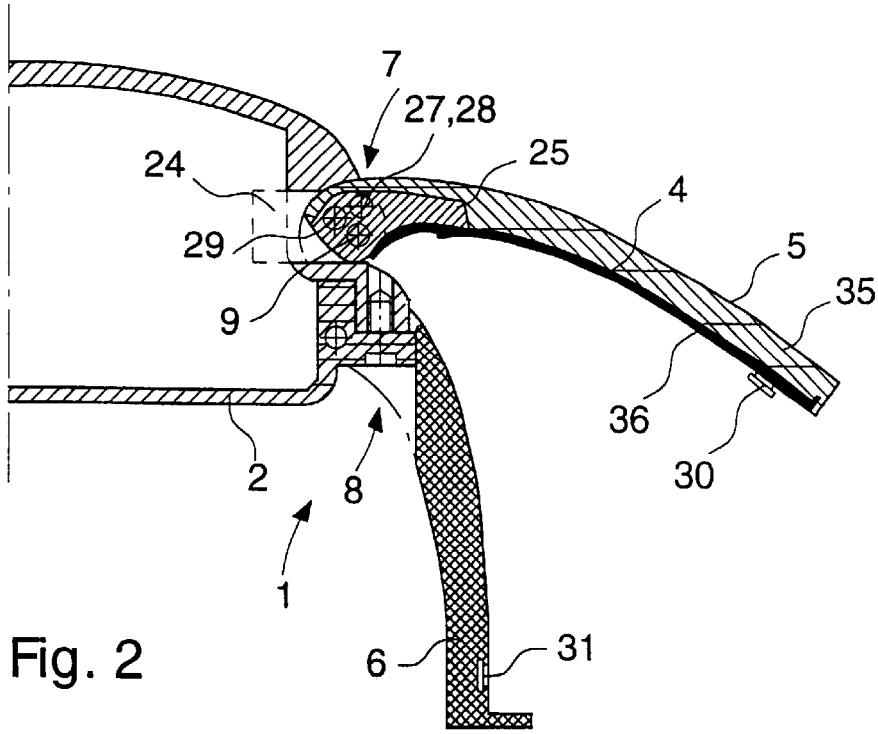
FIG. 2 is a cross-section of the watch illustrated in FIG. 1, the tongue being shown upright on the wristband.

As is seen in FIGS. 1, 2 and 3, antenna 4 is integrated in a tongue 5. Antenna 4 is a film or metal leaf sandwiched between two elements 35 and 36 forming tongue 5. Element 36 may be a capton® film bonded under element 35 formed for example of a polyimide plastic material.

DETAILED DESCRIPTION OF THE INVENTION

The Figures also show that one of ends 7 of tongue 5 is attached to case 2 above the place from which wristband 6 originates. According to an alternative embodiment, the tongue could of course be attached directly to wristband 6. Thus designed and attached, it will be understood that tongue 5 may be arranged in at least two positions. The first position is illustrated in FIG. 3 where tongue 5 runs alongside wristband 6 at least partially and is merged therewith. "Merged" means that the opposite faces of tongue 5 and the associated wristband strand are applied against each other. The second position is illustrated in FIGS. 1 and 2 where tongue 5 is moved away from wristband 6 and stands upright in the plane containing the circle defined by the wristband when it is worn.

The way in which the tongue is attached to the case or to the wristband and the place at which this attachment occurs, in particular on the wristband, can be imagined in various ways. In addition to the preferred manners of attachment here illustrated in the Figures, one may envisage an attachment which would use for example a semi-rigid plastic film, and an attachment which would be located, for example, half way between the case and a clasp fitted to two wristband strands.

However, in the preferred embodiment of the invention illustrated by the Figures, it can be seen that end 7 of tongue 5 is secured to case 2 by means of an articulation located above the place 8 from which the wristband originates on case 2. This place 8 can be at midday, as shown in FIG. 1, or at six o'clock.

More specifically, the Figures indicate that the articulation consists of a bar 9, whose function is similar to that used for attaching a wristband to a case. For this purpose and as is clearly seen in FIG. 4, case 2 or, more exactly place 8 from which wristband 6 originates on case 2, is provided with four horns 17, 18, 19 and 20 each pierced with a hole referenced respectively 10, 11, 12 and 13. For its part, end 7 of tongue 5 has three hinges 21, 22 and 23 each pierced with a hole referenced respectively 14, 15 and 16. Once the hinges are introduced between the horns, all the holes which they include are lined up and bar 9 can be introduced to form the articulation. It will be noted here that the articulation in question could only have two horns co-operating with a single hinge.

Figure 4:
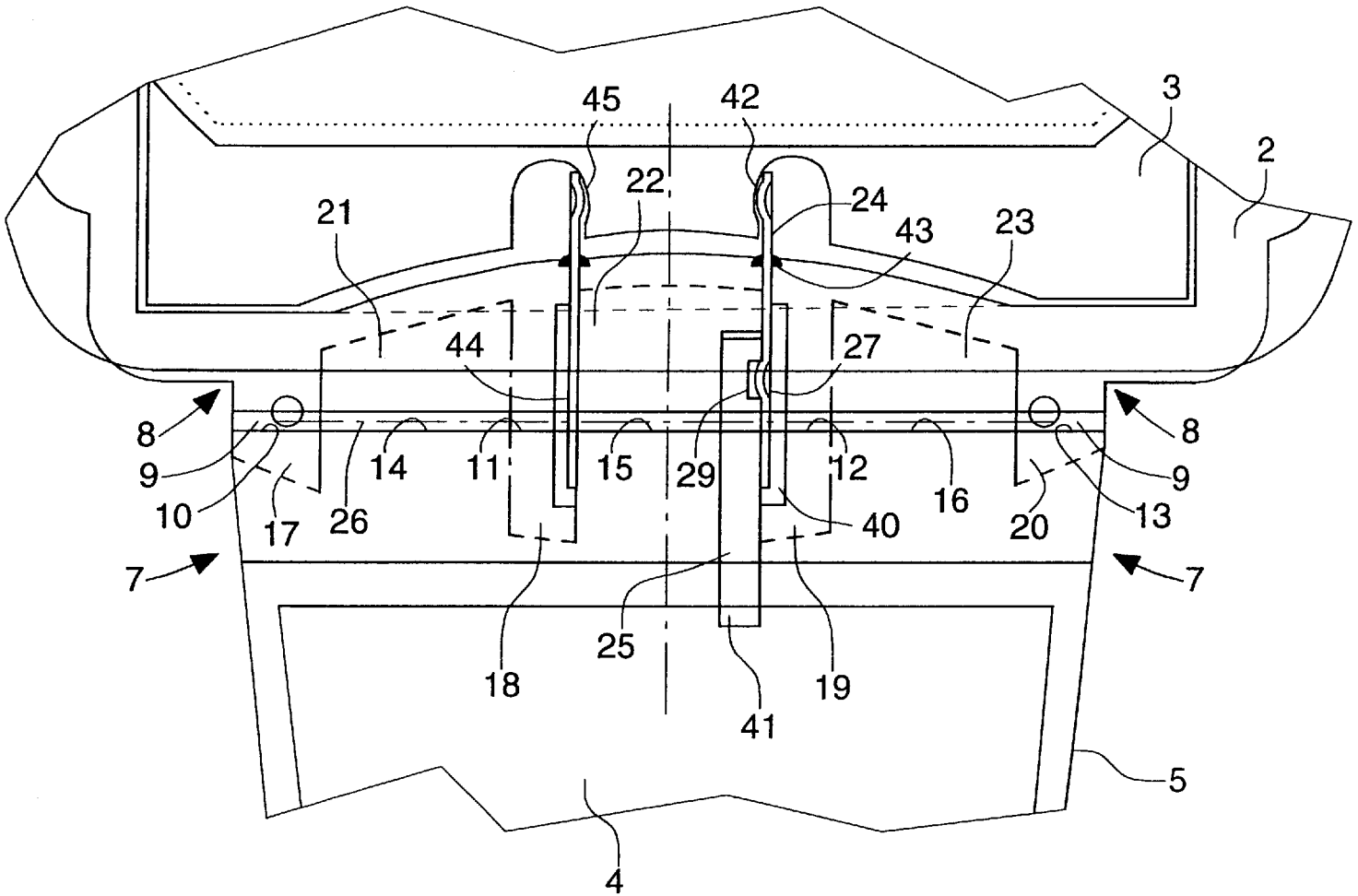
FIG. 4 is a plane view illustrating on the one hand the articulation of the tongue and on the other hand the connections connecting the antenna of the electronic device located inside the watch case.

FIG. 4 shows case 2 containing telephone device 3 and tongue 5 in which antenna 4 is integrated. Tongue 5 is hinged on case 2 at place 8 from which the wristband originates by means of a bar 9. Thus telephone device 3 is connected to antenna 4 by passing through the articulation described above. In order to do this, telephone device 3 is connected to antenna 4 by means of first strip 24 connected at 42 so said device and a second strip 25 connected at 41 to said antenna. FIG. 4 shows that strips 24 and 25 face each other in a plane perpendicular to axis 26 which contains bar 9. In order to do this, a portion of strip 25 is bent over perpendicular to the plane of FIG. 4 to face the other strip 24. Strips 24 and 25 are thus in rotating contact turning against each other and assure the connection between antenna 4 and telephone device 3.

More particularly, FIG. 4 shows that the first strip 24 runs alongside horn 19 of case 2 and that the second strip 25, in its bent over portion, runs alongside hinge 22 of tongue 5 at the place where horn 19 rotates against hinge 22. In order to assure a resilient contact between the two strips, FIG. 4 shows that horn 9 is provided with a recess 40 located on the back of strip 24 which assures a good rotating contact between strip 25 and strip 24, the latter being made of a resilient material. In order to assure a sealed passage for strip 24 from the inside to the outside of case 2, this strip can be overmoulded with the material of the case or bonded to this case as indicated at reference 43 of FIG. 4.

FIG. 4 shows another strip 44 coming out of case 2 and running alongside horn 18 of the case. This strip 44 is connected at 45 to the earth of telephone device 3. It is used to check that device 3 is operating properly before tongue 5 is attached to case 2.

Referring now to FIGS. 2, 3 and 4, it can be seen that the articulation is provided with a snap lacking device enabling tongue 5 to be held in the first or second position. In order to keep tongue 5 in the first position merged with wristband 6, FIGS. 3 and 4 show that strip 24 is provided with a bump 27 held in a notch 29 made in hinge 22. In order to keep tongue 5 in the second position standing upright above the wristband, bump 27 co-operates with another notch 28 made in hinge 22 (see FIG. 2).

If one wishes to ensure that tongue 5 is properly applied against wristband 6 when the tongue is in the position merged with the wristband, one may, as shown only in FIG. 2, provide tongue 5 with a stud 30 arranged to co-operate with a recess 31 arranged in wristband 6.

It was explained hereinabove that tongue 5 carrying antenna 4 stands upright in the second position to reduce the influence of the wearer's body and thus improve the amplitude of the radio frequency signal received by the antenna. The upright position of the tongue may also correspond to a so-called communication state of telephone device 3, in which it is given a full power supply. Conversely, the bent over position of the tongue may also correspond to a so-called standby state of device 3, in which it is given a reduced power supply, this power being just sufficient to keep device 5 listening for an incoming message. In order to switch from the standby state to the communication state, wristband 6 may be provided with a device 33 (see FIG. 1) sensitive to the proximity of an element 32 incorporated in tongue 5. Device 33 could be a Hall probe and element 32 a magnet.

The four Figures which illustrate this description show that tongue 5 is arranged to be superposed onto wristband 6 when said tongue is in its first position where it is merged with the wristband. For this purpose, the wristband has a thickness at the location of superposition reduced by a quantity substantially equivalent to the thickness of tongue 5 as is shown by the cross-sections of FIGS. 2 and 3. However, the invention is not limited to superposition but could be a juxtaposition. Tongue 5 could thus be of the same thickness as the wristband and be arranged beside it, the essential point being that the tongue runs alongside the wristband at least partially in a first position and is moved away from it upwards in a second position.

What is claimed is:

1. A wristwatch provided with a wristband and a case containing a telephone device able to receive and transmit broadcast messages received and transmitted by an antenna, wherein this antenna is integrated in a tongue having an end which is attached to the wristband or to the case, this tongue being able to be arranged in at least two positions, a first position, in which it runs alongside the wristband at least partly and is merged with it, and a second position in which it is moved away from the wristband and stands upright in a plane containing a circle defined by the wristband when it is worn.

2. A wristwatch according to claim 1, wherein the end of the tongue is attached to the case by means of an articulation located above a place from which the wristband originates on the case.

3. A wristwatch according to claim 2, wherein the tongue has a thickness and is arranged to be superposed onto the wristband when the tongue is in its first position, the wristband having, at the location of superposition, a thickness reduced by a quantity substantially equivalent to the thickness of the tongue.

4. A wristwatch according to claim 2, wherein the articulation consists of a bar passing through holes made in a row both in horns with which the case is provided, and in hinges of the end of the tongue, the telephone device being connected to the antenna by means of a first strip connected to said telephone device and a second strip connected to said antenna, these strips facing each other in a plane perpendicular to the axis of the bar, said strips being in rotating contact against each other.

5. A wristwatch according to claim 4, wherein the first strip runs alongside a horn of the case and wherein the second strip runs alongside a hinge of the tongue at the place where said horn and said hinge rotate against each other.

6. A wristwatch according to claim 2, wherein the articulation is provided with a snap locking device allowing the tongue to be held in the first or the second position.

7. A wristwatch according to claim 2, wherein the tongue is provided with a stud co-operating with a recess arranged in the wristband.

8. A wristwatch according to claim 2, wherein the wristband is provided with a device allowing the telephone device to be switched from a standby state to a communication state according to whether the tongue is located respectively in the first or the second position.

* * * * *